United States Patent [19]

Yamaguchi et al.

[11] Patent Number: 4,767,644

[45] Date of Patent: Aug. 30, 1988

[54] METHOD OF MAKING ABRASIVE TAPE

[75] Inventors: Nobutaka Yamaguchi; Masaaki Fujiyama; Masami Suzuki, all of Kanagawa, Japan

[73] Assignee: Fuji Photo Film Co., Ltd., Kanagawa, Japan

[21] Appl. No.: 39,841

[22] Filed: Apr. 20, 1987

[30] Foreign Application Priority Data

Apr. 18, 1986 [JP] Japan ..... 61-90540

[51] Int. Cl.[4] ..... B05D 3/02

[52] U.S. Cl. ..... 427/385.5; 51/295; 51/298; 51/309; 51/DIG. 19; 51/DIG. 22; 51/DIG. 24

[58] Field of Search ..... 51/295, 298, 309, DIG. 19, 51/DIG. 22, DIG. 24; 427/385.5

[56] References Cited

U.S. PATENT DOCUMENTS

| | | | |
|---|---|---|---|
| 4,138,229 | 2/1979 | Tadokoro et al. | 51/298 |
| 4,255,164 | 3/1981 | Butzke et al. | 51/295 |
| 4,263,003 | 4/1981 | Vork | 366/605 X |
| 4,317,660 | 3/1982 | Kramis et al. | 51/298 |
| 4,623,364 | 11/1986 | Cottringer et al. | 51/309 |

*Primary Examiner*—Thurman K. Page

*Attorney, Agent, or Firm*—Sughrue, Mion, Zinn, Macpeak & Seas

[57] ABSTRACT

A method of making an abrasive tape comprises the steps of preparing an abrasive composition at least from abrasive grains and a binder, applying the abrasive composition onto a flexible substrate, and drying the applied abrasive composition. The step of preparing the abrasive composition comprises kneading processing and attritor dispersion processing which are carried out for at least a part of the abrasive grains and at least a part of the binder.

14 Claims, No Drawings

METHOD OF MAKING ABRASIVE TAPE

BACKGROUND OF THE INVENTION

1. Field of the Invention

This invention relates to a method of making an abrasive tape used for polishing a magnetic head. This invention particularly relates to preparation of an abrasive composition which is to be applied onto a flexible substrate of the abrasive tape.

2. Description of the Prior Art

There has heretofore been known a method of making an abrasive tape by preparing an abrasive composition from abrasive grains and a binder, applying the abrasive composition onto a flexible substrate of continuous length, and then drying the applied abrasive composition.

In the conventional method of making an abrasive tape, it is necessary to decrease separation of the abrasive grains from the abrasive tape and to improve the smoothness of the abrasive coating film.

In order to solve these problems, it is necessary to prepare an appropriate abrasive composition. For this purpose, preparation of the abrasive composition should be carried out by appropriate processing. Specifically, in order to prevent separation of the abrasive grains from the abrasive tape, it is necessary to increase the bond strength between the abrasive grains and the binder. Also, in order to improve the smoothness of the abrasive coating film, it is necessary to uniformly disperse the abrasive grains in the form of primary grains in the binder. Processing capable of solving the aforesaid problems should be carried out with consideration to these requirements.

However, with the conventional method of preparing an abrasive composition by use of a ball mill as disclosed in, for example, Japanese Unexamined Patent Publication No. 55(1980)-129927, it is not always possible to substantially improve the bond strength between the abrasive grains and the binder within a short period, and to disperse the abrasive grains sufficiently up to the form of primary grains. Also with the method of preparing an abrasive composition by use of a roll mill as disclosed in, for example, Japanese Patent Publication No. 53(1978)-44714, it is not always possible to substantially improve the bond strength between the abrasive grains and the binder, and to disperse the abrasive grains sufficiently up to the form of primary grains.

SUMMARY OF THE INVENTION

The primary object of the present invention is to provide a method of making an abrasive tape, which decreases separation of abrasive grains from the abrasive tape.

Another object of the present invention is to provide a method of making an abrasive tape, which improves the smoothness of the abrasive coating film.

The present invention provides a method of making an abrasive tape by preparing an abrasive composition at least from abrasive grains and a binder, applying the abrasive composition onto a flexible substrate, and drying the applied abrasive composition, wherein the step of preparing said abrasive composition comprises kneading processing and attritor dispersion processing which are carried out for at least a part of said abrasive grains and at least a part of said binder.

With the method of making an abrasive tape in accordance with the present invention, preparation of the abrasive composition is carried out by two different processes, i.e. kneading processing and attritor dispersion processing, thereby to cope with each of the problems of the conventional techniques by the respective processes, and to cope with the problems as a whole by synergistic effects of the two processes.

Specifically, with kneading processing, the abrasive grains and the binder are kneaded in a high viscosity condition, the affinity between the abrasive grains and the binder is improved, and the bond strength therebetween is increased. Therefore, it is possible to prevent the abrasive grains from separating from the abrasive tape. As a result, it is possible to improve the durability of the abrasive coating film formed on the abrasive tape.

Also, with attritor dispersion processing, the abrasive grains are uniformly and finely dispersed up to the form of primary grains in the binder, so that no abrasive grains agglomerate in the abrasive composition. Therefore, the smoothness of the abrasive coating film is improved, and the finish polishing effect of the abrasive tape on a magnetic head is improved. Specifically, the risk of the surface of the magnetic head being scratched is minimized, and it becomes possible to improve the smoothness of the surface of the magnetic head.

Also, since the abrasive grains are finely dispersed by attritor dispersion processing and the bond strength between the abrasive grains and the binder is increased, the effect of preventing the abrasive grains from separating from the abrasive tape becomes more reliable than when kneading processing is carried out alone.

Further, in the case where attritor dispersion processing is carried out after kneading processing, it is possible to finely disperse the abrasive grains by attritor dispersion processing after the abrasive grains have been dispersed to some extent by kneading processing. Therefore, it is possible to form the abrasive coating film having the surface of a high smoothness within a period shorter than when attritor dispersion processing is carried out alone.

DETAILED DESCRIPTION OF THE INVENTION

In the present invention, the type, shapes and sizes of the abrasive grains are not limited, and may be selected arbitrarily in accordance with the purpose of the abrasive tape.

Also, the binder may be of any type insofar as it can cause the abrasive gains to adhere to the substrate. However, the binder should preferably be of the type having polarity and capable of contributing to dispersion of the abrasive grains. Nitrocellulose, and a vinyl chloride-vinyl acetate copolymer having a hydroxyl group or a carboxyl group are particularly preferable as the binder.

Kneading processing may be carried out by use of a pressure kneader (a pressure type double-arm kneader), an open kneader (a double-arm kneader), a triple roll mill, or the like. Among these kneaders, the pressure kneader and the open kneader are advantageous in that the abrasive composition can be kneaded strongly in a thick paste-like form and the operating characteristics are good. From the viewpoint of strong kneading, the pressure kneader is more advantageous than the open kneader. Kneading should be carried out strongly, and should preferably be conducted while the abrasive composition is in a thick paste-like form. Kneading should be carried out while the abrasive composition has a viscosity of at least not lower than 100 poise.

Attritor dispersion processing will be described hereinbelow. In general, the attritor utilizes balls or pebbles as the dispersion media, and comprises a stationary cylindrical tank filled with the dispersion media. Milling base (a pigment plus a vehicle slurry) is introduced into the cylindrical tank, a vertical rotation shaft disposed at the center of the tank and several arms secured at right angles to the rotation shaft are rotated, and sliding stress is continuously given by the rotating arms to the dispersion media, thereby to disperse the pigment in the vehicle of the mill base. By the term "attritor dispersion processing" as used herein is meant dispersion processing carried out by use of the attritor for finely dispersing the abrasive grains up to the form of primary grains. The dispersion time may be, for example, within the range of two to 48 hours, and should preferably be within the range of six to 24 hours. The dispersion media may be, for example, steel beads, alumina beads, zirconia beads, glass beads, or the like. The ratio of the apparent volume of the dispersion media in the tank of the attritor to the total volume of the tank, i.e. the apparent volume ratio, may be within the range of 100:100 to 100:800, and should preferably be within the range of 100:100 to 100:500. The apparent volume of the dispersion media is calculated by multiplying the height of the whole dispersion media in the tank by the bottom area of the tank. The viscosity of the abrasive composition in the course of attritor dispersion processing may be, for example, within the range of 10 to 300 poise, and should preferably be within the range of 20 to 200 poise, more preferably within the range of 30 to 150 poise.

Kneading processing and attritor dispersion processing need not necessarily be effected for the overall amount of the abrasive grains and the overall amount of the binder, and may be effected only for a part of the abrasive grains and a part of the binder. Thus kneading processing and attritor dispersion processing may be carried out only for not less than 10% of the overall amount of the abrasive grains, preferably for not less than 20% of the overall amount of the abrasive grains. As for the binder, kneading processing and attritor dispersion processing may be carried out only for not less than 10% of the overall amount of the binder, preferably for not less than 20% of the overall amount of the binder, more preferably for not less than 30% of the overall amount of the binder.

The abrasive composition may also contain additives such as a dispersing agent and a lubricant in addition to the abrasive grains and the binder.

The step of preparing the abrasive composition may also include various appropriate processes in addition to kneading processing and attritor dispersion processing. Also, kneading processing should preferably be carried out prior to attritor dispersion processing.

The aforesaid attritor, the pressure kneader, the open kneader, the ball mill, and the triple roll mill are described in detail in, for example, "Kongo Konren Gijutsu" (Mixing and Kneading Technology) by Yano, Nikkan Kogyo Shinbunsha, Aug. 20, 1980; "Paint Flow Pigment Dispersion" by T. C. Patton, Interscience Publishers, October 1966; "Bunsan Gijutsu Nyumon" (Guide to Dispersion Technology) by Koishi et al., Nikkan Kogyo Shinbunsha, Jan. 20, 1977; and "Konren Gijutsu" (Kneading Technology) by Hashimoto, Sangyo Gijutsu Center, Oct. 5, 1978.

The term "abrasive tape" as used herein broadly embraces the cases where the abrasive tape is in a long strip-like form, in a disk-like form and in a sheet-like form.

The present invention will further be illustrated by the following non-limitative examples.

EXAMPLE 1

An abrasive composition A as shown below was kneaded for 30 minutes by use of an open kneader until it became a thick paste-like form, and thereafter kneaded for further 30 minutes. Then, the abrasive composition A in the thick paste-like form was added with 100 parts of methyl ethyl ketone to convert it into a liquid form (60 poise), thereby to obtain an abrasive composition B. The abrasive composition B was then introduced into an attritor, and attritor dispersion processing was carried out for 18 hours to obtain an abrasive composition C, which had a viscosity of 70 poise. Steel beads having a diameter of ¼ inch were used as the dispersion media in the attritor, and the apparent volume ratio expressed as apparent volume of dispersion media: overall volume was adjusted to 100:120. Then, the abrasive composition C was filtered through a 3μ filter, applied onto a 12μ-thick polyester film to such a thickness that the applied composition had a thickness of 8μ in the dry state, and dried to form a coating film. The polyester film on which the coating film was overlaid in this manner was cut to ½ inch widths to obtain an abrasive tape 1. The content ratios of the abrasive grains and the binder among the constituents of the abrasive composition A are solid content ratios. Also, nitrocellulose used as the binder was dissolved in advance in methyl ethyl ketone as the solvent.

| | |
|---|---|
| Abrasive grains, $\alpha$-$Al_2O_3$ (diameter: 0.3μ) | 300 parts |
| Nitrocellulose | 50 parts |
| Methyl ethyl ketone | 200 parts |
| Lecithin (dispersing agent) | 1.5 parts |

EXAMPLE 2

An abrasive composition D as shown below was kneaded for 30 minutes by use of a pressure kneaker until it became a thick paste-like form, and thereafter kneaded for one more hour. Then, the kneaded abrasive composition D was further kneaded while blowing dry air thereto, and so that the abrasive composition D was pulverized to sizes of several centimetes in diameter. The pulverized composition was then introduced into an attritor together with an abrasive composition E as shown below, and attritor dispersion processing was carried out for 24 hours to obtain an abrasive composition F, which had a viscosity of 85 poise. Steel beads having a diameter of ¼ inch were used as the dispersion media in the attritor, and the apparent volume ratio expressed as apparent volume of dispersion media: overall volume was adjusted to 100:120. Then, the abrasive composition F was filtered through a 3μ filter, introduced into a stirrer together with an abrasive composition G as shown below, and an abrasive composition H was prepared in this manner. The abrasive composition H has a viscosity of 80 poise. Then, the abrasive composition H was filtered through a 3μ filter, applied onto a 12μ-thick polyester film to such a thickness that the applied composition had a thickness of 8μ in the dry state, and dried to form a coating film. The polyester film on which the coating film was overlaid in this manner was cut to ½ inch widths to obtain an abrasive tape 2.

| | |
|---|---|
| Abrasive composition D (in parts by weights): | |
| Abrasive grains, $\gamma$-$Fe_2O_3$ (size: 1.0$\mu$ × 0.1$\mu$ × 0.1$\mu$) | 200 parts |
| Vinyl chloride-vinyl acetate-vinyl alcohol copolymer | 80 parts |
| Amyl stearate | 2.0 parts |
| Methyl ethyl ketone | 100 parts |
| n-Butyl acetate | 320 parts |
| Abrasive composition E: | |
| Abrasive grains, $Cr_2O_3$ (diameter: 0.3$\mu$) | 150 parts |
| Carbon black | 30 parts |
| Methyl ethyl ketone | 100 parts |
| Cyclohexanone | 350 parts |
| Oleic acid | 3 parts |
| Silicone oil | 0.2 part |
| Fluorine-based oil | 1 part |
| Liquid paraffin | 1 part |
| Butyl stearate | 1 part |
| Surface active agent | 2 parts |
| Abrasive composition G: | |
| Isocyanate-terminated prepolymer (curing agent) | 35 parts |

COMPARATIVE EXAMPLE 1

The abrasive composition A in Example 1 was introduced into a ball mill together with 100 parts of methyl ethyl ketone, and dispersion processing was carried out for 96 hours. Steep beads having a diameter of ¾ inch were used as the dispersion media.

The composition thus obtained by dispersion processing was filtered through 3$\mu$ filter, applied onto a 12$\mu$-thick polyester film to such a thickness that the applied composition had a thickness of 8$\mu$ in the dry state, and dried to form a coating film. The polyester film on which the coating film was overlaid in this manner was cut to ½ inch widths to obtain an abrasive tape 3.

COMPARATIVE EXAMPLE 2

The abrasive composition A in Example 1 and methyl ethyl ketone (not less than 100 parts) were kneaded by use of a triple roll mill to obtain an abrasive slurry of a low viscosity (5 poise). The amount of the solvent added was adjusted in the course of kneading so that the viscosity was maintained approximately on the same level. Then, the abrasive slurry was filtered through 5$\mu$ filter (filtering could not be carried out appropriately with a 3$\mu$ filter), applied onto a 12$\mu$-thick polyester film to such a thickness that the applied composition had a thickness of 8$\mu$ in the dry state, and dried to form a coating film. The polyester film on which the coating film was overlaid in this manner was cut to ½ inch widths to obtain an abrasive tape 4.

For the abrasive tapes 1 through 4 made in Examples 1 and 2 and Comparative Examples 1 and 2, the number of the abrasive grains separated from the abrasive tape and the surface roughness (Ra) were measured. The results are shown in the table below. The number of abrasive grains separated from the abrasive tape was measured by observing the surface of the abrasive tape after the abrasive tape was used for polishing a ferrite magnetic head by use of an electron microscope (magnification: 5,000), counting the number of abrasive grains separated from the abrasive tape in terms of the number of dimples indicating the separation of the abrasive grains, and expressing the count as a relative value. The surface roughness (Ra) was determined by measuring the arithmetical mean deviation of the surface of the coating film. The cutoff value was 0.8 mm, the radius of the stylus was 2$\mu$, and the stylus speed was 0.3 mm/sec.

| | Number of abrasive grains separated (relative value) | Surface roughness (Ra) |
|---|---|---|
| Example 1 (abrasive tape 1) | 1.5 | 0.10 |
| Example 2 (abrasive tape 2) | 1 | 0.08 |
| Comp. Example 1 (abrasive tape 3) | 13 | 1.62 |
| Comp. Example 2 (abrasive tape 4) | 25 | 2.35 |

As is clear from the table shown above, with the abrasive tapes of Examples 1 and 2 in accordance with the present invention, it is possible to prevent separation of the abrasive grains from the abrasive tape and to make the surface of the abrasive coating film of the abrasive tape smooth.

The present invention is not limited to Examples 1 and 2, and may be embodied in various other manners.

We claim:

1. A method of making an abrasive tape comprising:

(1) preparing an abrasive composition at least from abrasive grains and a binder, (2) applying the abrasive composition onto a flexible substrate, and (3) drying the applied abrasive composition, wherein the step of preparing said abrasive composition comprises kneading processing, which is carried out while the abrasive composition being kneaded has a viscosity of at least 100 poise, and attritor dispersion processing, said kneading processing and attritor dispersion processing being carried out on at least 10% of an overall amount of said abrasive grains and at least a part of said binder and providing that said steps of kneading processing and attritor dispersion processing can be carried out in either order.

2. A method as defined in claim 1 wherein said binder is selected from the group consisting of nitrocellulose and a vinyl chloride-vinyl acetate copolymer having a hydroxyl group or a carboxyl group.

3. A method as defined in claim 1 wherein said kneading processing is carried out prior to said attritor dispersion processing.

4. A method as defined in claim 1 wherein said attritor dispersion processing is carried out for a period within the range of two to 48 hours.

5. A method as defined in claim 4 wherein said attritor dispersion processing is carried out for a period within the range of six to 24 hours.

6. A method as defined in claim 1 wherein the ratio of the apparent volume of dispersion media in an attritor tank to the total volume of the attritor tank, is adjusted to a value within the range of 100:100 to 100:800 in the course of said attritor dispersion processing.

7. A method as defined in claim 6 wherein the ratio of the apparent volume of dispersion media in an attritor tank to the total volume of the attritor tank, is adjusted to a value within the range of 100:100 to 100:500 in the course of said attritor dispersion processing.

8. A method as defined in claim 1 wherein the viscosity of said abrasive composition is adjusted to a value within the range of 10 to 300 poise in the course of said attritor dispersion processing.

9. A method as defined in claim 8 wherein the viscosity of said abrasive composition is adjusted to a value within the range of 20 to 200 poise in the course of said attritor dispersion processing.

10. A method as defined in claim 9 wherein the viscosity of said abrasive composition is adjusted to a value within the range of 30 to 150 poise in the course of said attritor dispersion processing.

11. A method as defined in claim 1 wherein said kneading processing and said attritor dispersion processing are carried out only for not less than 10% of the overall amount of said binder.

12. A method as defined in claim 1 wherein said kneading processing and said attritor dispersion processing are carried out only for not less than 20% of the overall amount of said abrasive grains.

13. A method as defined in claim 11 wherein said kneading processing and said attritor dispersion processing are carried out only for not less than 20% of the overall amount of said binder.

14. A method as defined in claim 13 wherein said kneading processing and said attritor dispersion processing are carried out only for not less than 30% of the overall amount of said binder.

* * * * *